US008786627B2

(12) United States Patent
Park et al.

(10) Patent No.: US 8,786,627 B2
(45) Date of Patent: Jul. 22, 2014

(54) METHOD FOR DISPLAYING VIDEO SIGNAL DITHERED BY RELATED MASKS AND VIDEO DISPLAY APPARATUS APPLYING THE SAME

(75) Inventors: Ji-yong Park, Suwon-si (KR); Sang-kyun Im, Seoul (KR); Nam-kyun Beon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 263 days.

(21) Appl. No.: 12/835,894

(22) Filed: Jul. 14, 2010

(65) Prior Publication Data

US 2011/0141365 A1 Jun. 16, 2011

(30) Foreign Application Priority Data

Dec. 10, 2009 (KR) ..... 10-2009-0122701

(51) Int. Cl.
*G09G 5/02* (2006.01)

(52) U.S. Cl.
USPC ..... 345/596; 348/606; 348/607; 348/624; 348/678; 348/679; 345/597; 345/598; 345/599; 358/3.13

(58) Field of Classification Search
USPC ..... 348/571, 574, 725, 441, 607, 624, 606, 348/678, 679; 345/596–599, 690
See application file for complete search history.

(56) References Cited

U.S. PATENT DOCUMENTS

| | | | | |
|---|---|---|---|---|
| 5,469,190 | A * | 11/1995 | Masterson | 345/605 |
| 6,008,794 | A * | 12/1999 | Ishii | 345/598 |
| 7,110,010 | B1 * | 9/2006 | Masuji et al. | 345/692 |
| 7,808,510 | B2 * | 10/2010 | Miyasaka | 345/600 |
| 7,884,813 | B2 * | 2/2011 | Seki | 345/204 |
| 7,903,123 | B1 * | 3/2011 | Alben et al. | 345/596 |
| 7,940,281 | B2 * | 5/2011 | Wang et al. | 345/596 |
| 8,050,517 | B2 * | 11/2011 | Kim et al. | 382/283 |
| 8,164,604 | B2 * | 4/2012 | Chung et al. | 345/694 |
| 8,400,463 | B2 * | 3/2013 | Wang | 345/596 |
| 2004/0125117 | A1 * | 7/2004 | Suzuki et al. | 345/690 |
| 2005/0248508 | A1 * | 11/2005 | Seong et al. | 345/63 |
| 2006/0092172 | A1 * | 5/2006 | Tung et al. | 345/596 |
| 2006/0232797 | A1 * | 10/2006 | Hayaishi | 358/1.9 |
| 2008/0158269 | A1 * | 7/2008 | Wang et al. | 345/698 |
| 2009/0128584 | A1 * | 5/2009 | Lee et al. | 345/690 |
| 2010/0110301 | A1 * | 5/2010 | Ota et al. | 348/671 |

FOREIGN PATENT DOCUMENTS

| | | | |
|---|---|---|---|
| EP | 1587053 | A2 * | 10/2005 |
| JP | 2003-345288 | A | 12/2003 |
| JP | 2003345288 | A * | 12/2003 |

OTHER PUBLICATIONS

Search Report dated Mar. 28, 2011 from the European Patent Office in a counterpart European Application No. 10191395.2.

* cited by examiner

*Primary Examiner* — Jefferey Harold
*Assistant Examiner* — Humam Satti
(74) *Attorney, Agent, or Firm* — Sughrue Mion, PLLC

(57) ABSTRACT

A method for displaying a video which is dithered using related masks and a video display apparatus applying the same, the video display apparatus dithering a video signal using a first mask, performing color-processing with respect to the video signal, and dithering the color-processed video signal using a second mask which is related to the first mask. Accordingly, dithering is performed using related masks, thus preventing poor gradation of video signal.

21 Claims, 10 Drawing Sheets

FIG. 3

| | FRONT MASK | POST MASK |
|---|---|---|
| 1 | 3 1<br>2 0 | 0 2<br>1 3 |
| 2 | 2 3<br>0 1 | 1 0<br>3 2 |
| 3 | 0 2<br>1 3 | 3 1<br>2 0 |
| 4 | 1 0<br>3 2 | 2 3<br>0 1 |

METHOD FOR DISPLAYING VIDEO SIGNAL DITHERED BY RELATED MASKS AND VIDEO DISPLAY APPARATUS APPLYING THE SAME

CROSS-REFERENCE TO RELATED APPLICATION

This application claims priority from Korean Patent Application No. 10-2009-0122701, filed on Dec. 10, 2009 in the Korean Intellectual Property Office, the disclosure of which is incorporated herein by reference in its entirety.

BACKGROUND

1. Field

Apparatuses and methods consistent with the exemplary embodiments relate to a video display apparatus, and more particularly, to a video display apparatus which displays obtained video signals on a display in order for a user to see them.

2. Description of the Related Art

If color processing is performed on a video signal, the number of bits of the video signal increases. Accordingly, if the number of bits of the video signal exceeds the number of bits that can be processed on the display, the number of bits is required to be reduced.

Dithering is a representative signal processing method to reduce the number of bits of a video signal. That is, dithering is a signal processing method to reduce the number of bits of a video signal as much as required.

However, dithering inevitably results in loss of data of the video signal, thus causing poor gradation. Therefore, there is a demand for a dithering method that prevents poor gradation.

SUMMARY

Exemplary embodiments overcome the above disadvantages and other disadvantages not described above. However, it is understood that an exemplary embodiment is not required to overcome the disadvantages described above, and an exemplary embodiment may not overcome any of the problems described above.

Exemplary embodiments provide a method for displaying a video dithered using related masks and a video display apparatus applying the same, which can prevent poor gradation.

According to an aspect of an exemplary embodiment, there is provided a video display apparatus including: a video processor which performs signal-processing with respect to an input video signal; and a video output unit which displays the video signal which is signal-processed by the video processor on a display, wherein the video processor includes: a first dithering unit which dithers the video signal using a first mask, a color processor which performs color-processing with respect to the video signal which is output from the first dithering unit, and a second dithering unit which dithers the video signal, which is color-processed by the color processor, using a second mask related to the first mask.

The first mask may have the same format as the second mask.

The second mask may include coefficients which compensate for corresponding coefficients of the first mask.

A sum of a coefficient at a first location of the first mask and a coefficient at a corresponding first location of the second mask may equal to a sum of a coefficient at a second location of the first mask and a coefficient at a corresponding second location of the second mask.

The second dithering unit may dither the video signal, which is color processed, using an error diffusion dithering scheme, and may dither the video signal, which is dithered using the error diffusion dithering scheme, using the second mask.

The first dithering unit may dither the video signal using the first mask if a bit unit of the video signal exceeds a predetermined bit unit, and may not dither the video signal if the bit unit of the video signal is the predetermined bit unit.

The second dithering unit may dither the video signal using the second mask if a bit unit of the video signal input to the first dithering unit exceeds the predetermined bit unit, and may dither the video signal using a third mask if the bit unit of the video signal input to the first dithering unit is the predetermined bit unit.

The third mask may have a format which is larger than a format of the second mask.

The video signal may be at least one of a video signal which is separated from a received broadcast signal and a video signal which is received from an external apparatus.

According to an aspect of another exemplary embodiment, there is provided a video display method including: a first dithering operation which dithers a video signal using a first mask; performing color-processing with respect to the video signal which is dithered in the first dithering operation; a second dithering operation which dithers the video signal, which is color-processed, using a second mask related to the first mask; and displaying the video signal which is dithered in the second dithering operation on a display.

The first mask may have a same format as the second mask.

The second mask may include coefficients which compensate for corresponding coefficients of the first mask.

A sum of a coefficient at a first location of the first mask and a coefficient at a corresponding first location of the second mask may be equal to a sum of a coefficient at a second location of the first mask and a coefficient at a corresponding second location of the second mask.

The second dithering operation may dither the color-processed video signal using an error diffusion dithering scheme, and may dither the video signal, which is dithered using the error diffusion dithering scheme, using the second mask.

The first dithering operation may dither the first video signal using the first mask if a bit unit of the video signal exceeds a predetermined bit unit, and may not dither the video signal if the bit unit of the video signal is the predetermined bit unit.

The second dithering operation may dither the video signal using the second mask if a bit unit of the video signal exceeds the predetermined bit unit, and may dither the video signal using a third mask if the bit unit of the video signal is the predetermined bit unit.

The third mask may have a format which is larger than that of the second mask.

The video signal may be at least one of a video signal which is separated from a received broadcast signal and a video signal which is received from an external apparatus.

According to an aspect of another exemplary embodiment, there is provided a video processor including: a first dithering unit which dithers a video signal using a first mask; a color processor which performs color-processing with respect to the dithered video signal output from the first dithering unit; and a second dithering unit which dithers the color-processed video signal using a second mask related to the first mask.

Additional aspects and advantages of the present invention will be set forth in the detailed description, will be obvious from the detailed description, or may be learned by practicing the invention.

BRIEF DESCRIPTION OF THE DRAWINGS

The above and/or other aspects will be more apparent by describing in detail exemplary embodiments, with reference to the accompanying drawings in which:

FIG. 3 is a view illustrating front masks and post masks;

DETAILED DESCRIPTION OF THE EXEMPLARY EMBODIMENTS

Figure 1:
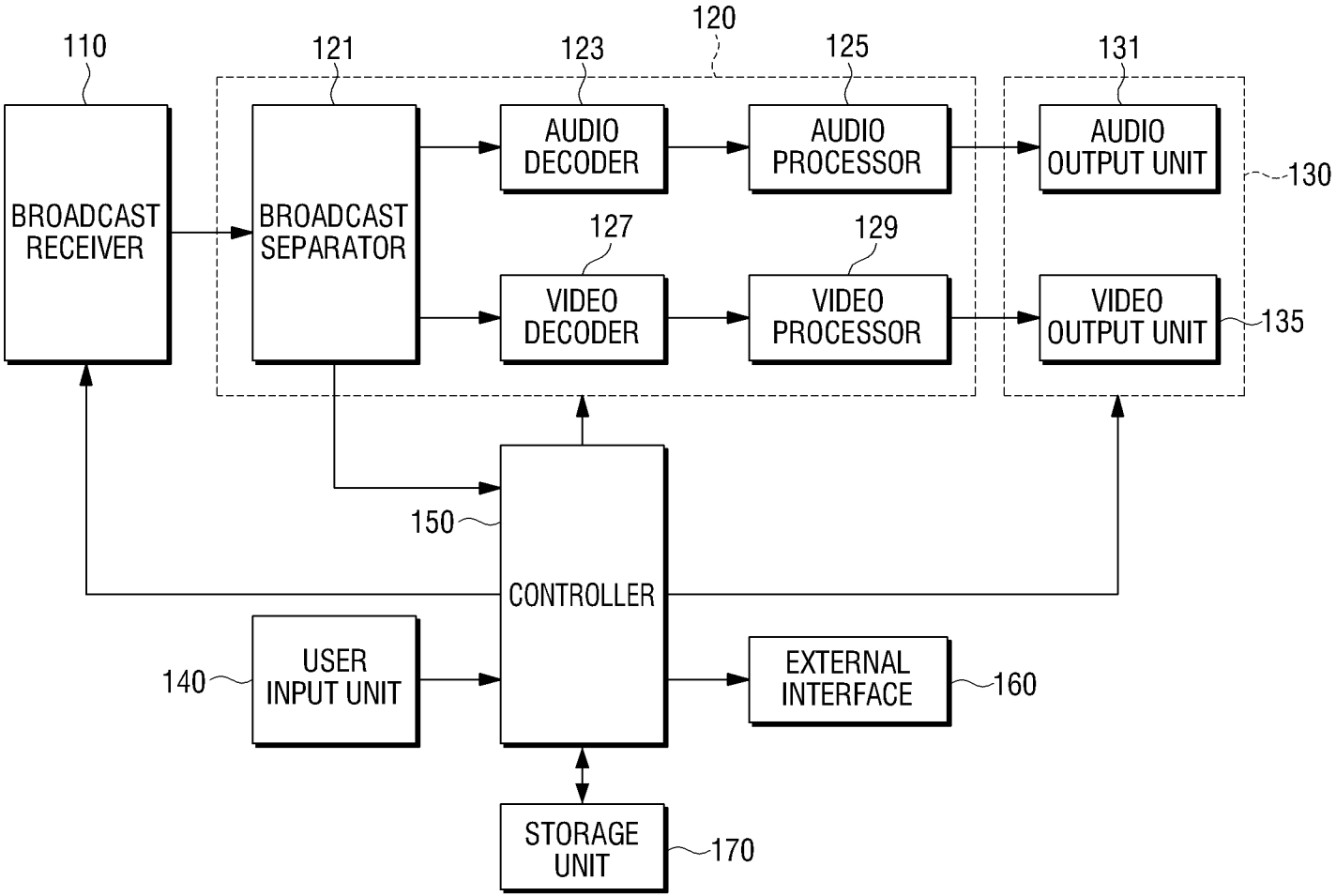
FIG. 1 is a block diagram illustrating a digital television (DTV), which is an example of a video display apparatus according to an exemplary embodiment.

Hereinafter, exemplary embodiments will be described in greater detail with reference to the accompanying drawings. In the following description, same reference numerals are used for the same elements when they are depicted in different drawings. The matters defined in the description, such as detailed constructions and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail. Expressions such as "at least one of," when preceding a list of elements, modify the entire list of elements and do not modify the individual elements of the list.

1. Digital Television, an Example of a Video Display Apparatus According to an Exemplary Embodiment FIG. 1 is a block diagram illustrating a digital television (DTV), which is an example of a video display apparatus according to an exemplary embodiment. As shown in FIG. 1, the DTV includes a broadcast receiver 110, a broadcast processor 120, a broadcast output unit 130, a user input unit 140, a controller 150, an external interface 160, and a storage unit 170.

The broadcast receiver 110 tunes to and demodulates any one of broadcast signals which are received in a wireless or a wired manner through air or cable.

The broadcast processor 120 performs signal-processing with respect to the broadcast signal which is output from the broadcast receiver 110. The broadcast processor 120 includes a broadcast separator 121, an audio decoder 123, an audio processor 125, a video decoder 127, and a video processor 129.

The broadcast separator 121 divides the broadcast signal output from the broadcast receiver 110 into an audio signal, a video signal, and additional data, and outputs the audio signal, the video signal, and the additional data. The audio signal and the video signal which are separated from the broadcast signal are applied to the audio decoder 123 and the video decoder 127, respectively, and are used to provide a digital broadcast program. The additional data separated from the broadcast signal is applied to the controller 150. The additional data may be program and system information protocol (PSIP) information.

The audio decoder 123 decodes the audio signal output from the broadcast separator 121. Accordingly, the audio decoder 123 outputs a decompressed audio signal.

The audio processor 125 converts the audio signal which is decoded by the audio decoder 123 into an audio signal of a format which can be output through a speaker provided on the DTV.

The video decoder 127 decodes the video signal output from the broadcast separator 121. Accordingly, the video decoder 127 outputs a decompressed video signal.

The video processor 129 converts the video signal which is decoded by the video decoder 127 into a video signal of a format that can be output through a display provided on the DTV. To achieve this, the video processor 129 may perform scaling and color processing with respect to the decoded video signal. The video processor 129 will be described in detail with reference to FIG. 2.

The output unit 130 outputs video and audio, which correspond to the video signal and the audio signal output from the broadcast processor 120, to a user. The output unit 130 includes an audio output unit 131 and a video output unit 135.

The audio output unit 131 outputs the audio signal which is output from the audio processor 125 through a speaker, and the video output unit 135 displays the video signal which is output from the video processor 129 on a display.

The external interface 160 is communicably connected to an external device (for example, a USB memory or a digital camera) and an external network (for example, Internet or a local area network (LAN)).

The storage unit 170 is a recording medium which stores programs and information for the controller 150 to perform a DTV operation.

The storage unit 170 may be a volatile or non-volatile storage, and may be an internal or external storage.

The user input unit 140 transmits a user command which is input through an input device provided on a remote controller or a front panel of the DTV to the controller 150. For example, the input device may be a manipulation button, a rotatable dial, a touch screen, etc.

The controller 150 controls the overall operation of the DTV according to a user command transmitted from the user input unit 140. More specifically, the controller 150 controls the broadcast receiver 110, the broadcast processor 120, and the broadcast output unit 130 to receive and output a broadcast program selected by the user.

2. Detailed Configuration of the Video Processor

Figure 2:
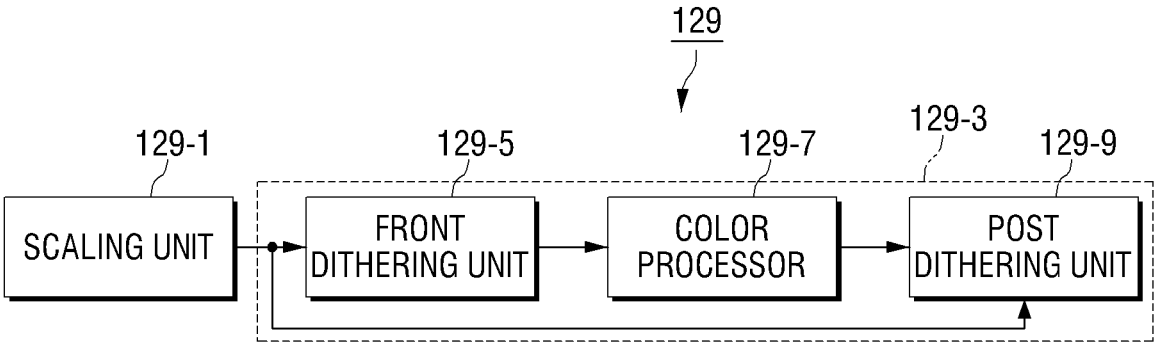
FIG. 2 is a block diagram illustrating the video processor of FIG. 1.

Hereinafter, the video processor 129 will be described in detail with reference to FIG. 2. FIG. 2 is a block diagram illustrating the video processor 129 of FIG. 1 in detail.

As shown in FIG. 2, the video processor 129 includes a scaling unit 129-1 and a color processing module 129-3. The color processing module 129-3 includes a front dithering unit 129-5, a color processor 129-7, and a post dithering unit 129-9.

The scaling unit 129-1 scales the video signal decoded by the video decoder 127 according the size of the display.

The front dithering unit 129-5 dithers the video signal output from the scaling unit 129-1, thereby generating, for example, an 8-bit-unit video signal. The 8-bit-unit video signal indicates that color signals (R signal, G signal, and B signal) for one pixel of a video signal each are 8 bits long.

The front dithering unit 129-5 performs a dithering operation according to a spatial and temporal dithering scheme using a front mask. The front dithering unit 129-5 does not dither all video signals output from the scaling unit 129-1. For example, if the scaling unit 129-1 outputs an 8-bit-unit video signal and a 10-bit-unit video signal, the front dithering unit 129-5 may dither only the 10-bit-unit video signal. That is, the front dithering unit 129-5 provides an 8-bit-unit video signal to the color processor 129-7, such that if an 8-bit-unit video signal is input to the front dithering unit 129-5, a dithering operation is not required.

The color processor 129-7 performs color processing with respect to the video signal output from the front dithering unit 129-5. For example, the color processor 129-7 performs color processing such as color correction, white balance adjustment, and gamma correction.

The color processor 129-7 outputs the color-processed video signal to the post dithering unit 129-9. The video signal output from the color processor 129-7 is 14 bits long per one unit because a bit resolution of the video signal increases due to the color processing.

The post dithering unit 129-9 dithers the 14-bit-unit video signal output from the color processor 129-7, thereby generating an 8-bit-unit video signal. The post dithering unit 129-9 performs a dithering operation according to a spatial and temporal dithering scheme and an error diffusion dithering scheme.

The post dithering unit 129-9 performs a corresponding dithering operation according to the bit unit of the video signal output from the scaling unit 129-1, that is, the bit unit of the video signal input to the front dithering unit 129-5. More specifically, if a 10-bit-unit video signal is input to the front dithering unit 129-5, the post dithering unit 129-9 dithers lower 4 bits of the video signal according to the error diffusion dithering scheme, and then dithers the next lower 2 bits of the video signal according to the spatial and temporal dithering scheme using a post mask.

On the other hand, if an 8-bit-unit video signal is input to the front dithering unit 129-5, the post dithering unit 129-9 dithers lower 2 bits of the video signal according to the error diffusion dithering scheme, and then dithers the next lower 4 bits of the video signal according to the spatial and temporal dithering scheme using a 4×4 mask.

3. Mask Used in Dithering

As described above, three types of masks are used in dithering. That is, a front mask is used in the front dithering unit 129-5 and a post mask and a 4×4 mask are used in the post dithering unit 129-9.

The front masks and the post masks are illustrated in FIG. 3. As illustrated in FIG. 3, the front mask and the post mask are paired with each other and are complementary to each other. The front mask and the post mask have the same 2×2 format. The coefficients of the post mask compensate for the coefficients of the corresponding front mask. That is, the sum of a coefficient at (m, n) of the front mask and a coefficient at (m, n) of the post mask is always 3.

For example, in the first pair of front and post masks, the sum of a coefficient 3 at (1, 1) of the front mask and a coefficient 0 at (1, 1) of the post mask is 3, which is the same as the sum of a coefficient 1 at (1, 2) of the front mask and a coefficient 2 at (1, 2) of the post mask, the sum of a coefficient 2 at (2, 1) of the front mask and a coefficient 1 at (2, 1) of the post mask, and the sum of a coefficient 0 at (2, 2) of the front mask and a coefficient 3 at (2, 2) of the post mask.

The front dithering unit 129-5 and the post dithering unit 129-9 use one of the pairs of front and post masks illustrated in FIG. 3. That is, if the front dithering unit 129-5 uses the second front mask shown in FIG. 3, the post dithering unit 129-9 uses the second post mask. In order to determine which pair of masks to use randomly, a linear feedback shift register (LFSR) may be used.

The 4×4 mask is larger than a 2×2 post mask in its format size. Accordingly, the 2×2 post mask performs a dithering operation with respect to 2 bits, whereas the 4×4 mask performs a dithering operation with respect to 4 bits.

4. Detailed Dithering Process

Figure 4:
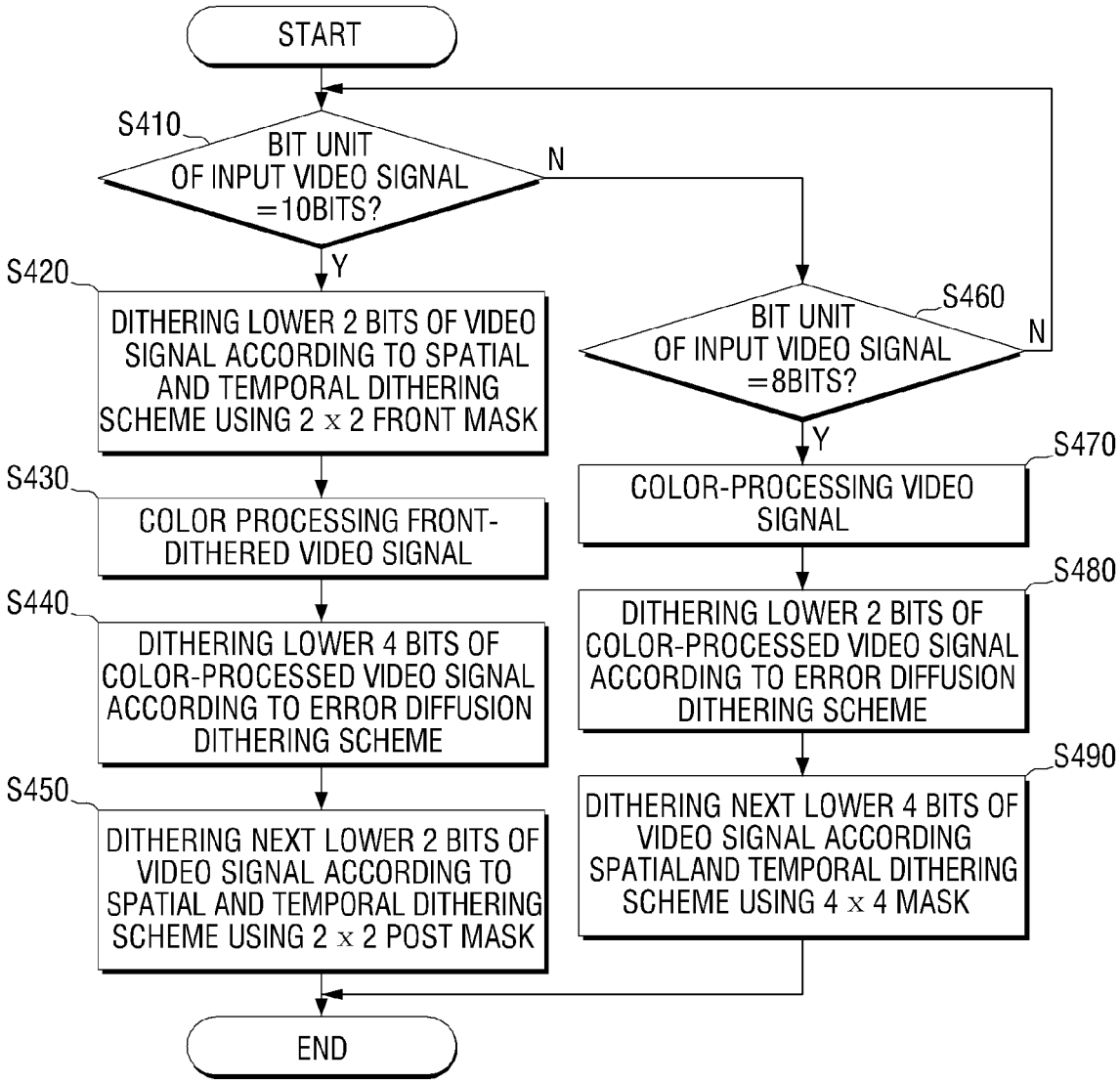
FIG. 4 is a flowchart illustrating dithering and color processing operations performed by the color processing module of FIG. 1.

Hereinafter, dithering and color processing operations performed by the color processing module 129-3 of FIG. 2 will be described in detail with reference to FIG. 4. As shown in FIG. 4, the front dithering unit 129-5 determines a bit unit of an input video signal (S410, S460). The bit unit refers to the number of bits of each of the color signals (R signal, G signal, and B signal) for one pixel of a video signal.

If the bit unit of the input video signal is determined to be 10 bits (S410-Y), the front dithering unit 129-5 dithers lower 2 bits of the video signal according to the spatial and temporal dithering scheme using the 2×2 front mask (S420).

Figure 5A:
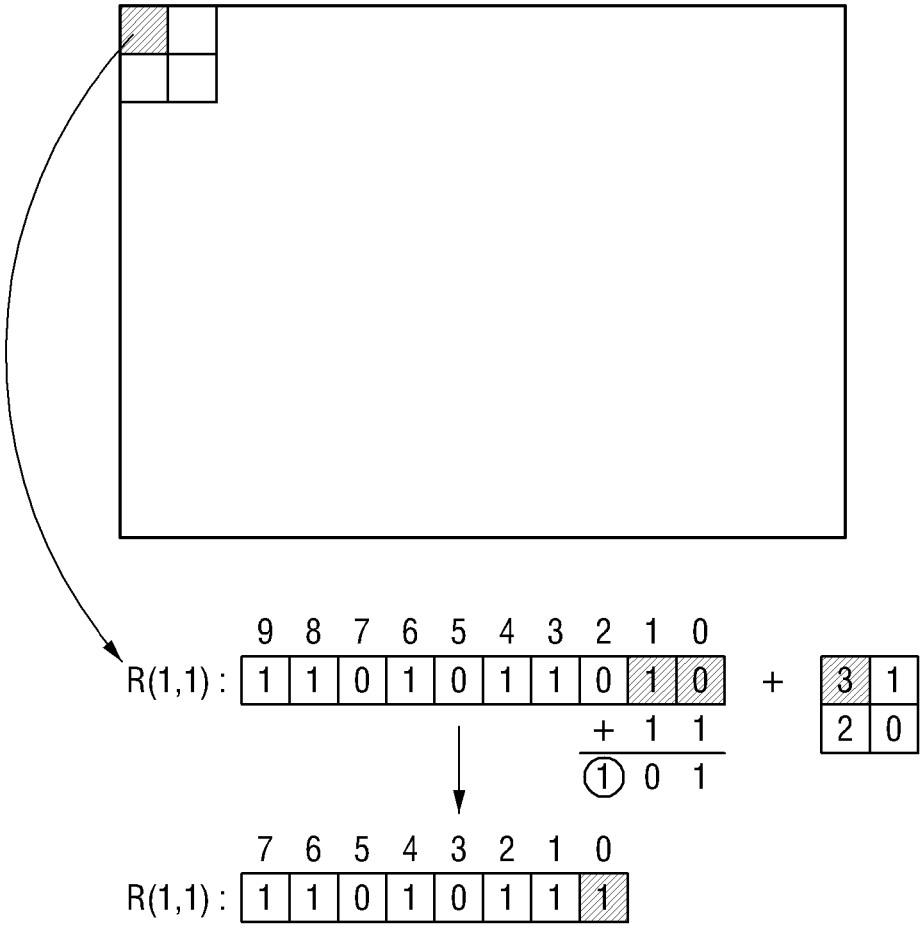
FIGS. 5A and 5B are views provided to explain a front dithering operation according to an exemplary embodiment.

In order to provide a detailed description of the front dithering operation performed in operation S420, FIG. 5A illustrates a front dithering operation performed with respect to an R signal of a pixel [1, 1] of a video signal. In FIG. 5A, the R signal of the pixel [1, 1] is 1101011010, and the first front mask [3, 1, 2, 0] is selected from among the front masks illustrated in FIG. 3.

In order to perform a dithering operation with respect to the R signal of the pixel [1, 1], a coefficient 3 at [1, 1] of the front mask is used. More specifically, the sum of lower 2 bits, 10, of the R signal and a binary number, 11, of the coefficient 3 at [1, 1] of the front mask is calculated. The calculation result ($10_2+11_2=101_2$) is 3 bits, which requires rounding up the number of bits. Accordingly, the lower 2 bits of the R signal are removed and 1 is added to the final bit. Then, the R signal becomes 11010111 as a result of performing the front dithering operation with respect to the R signal of the pixel [1, 1] of the video signal.

Figure 5B:
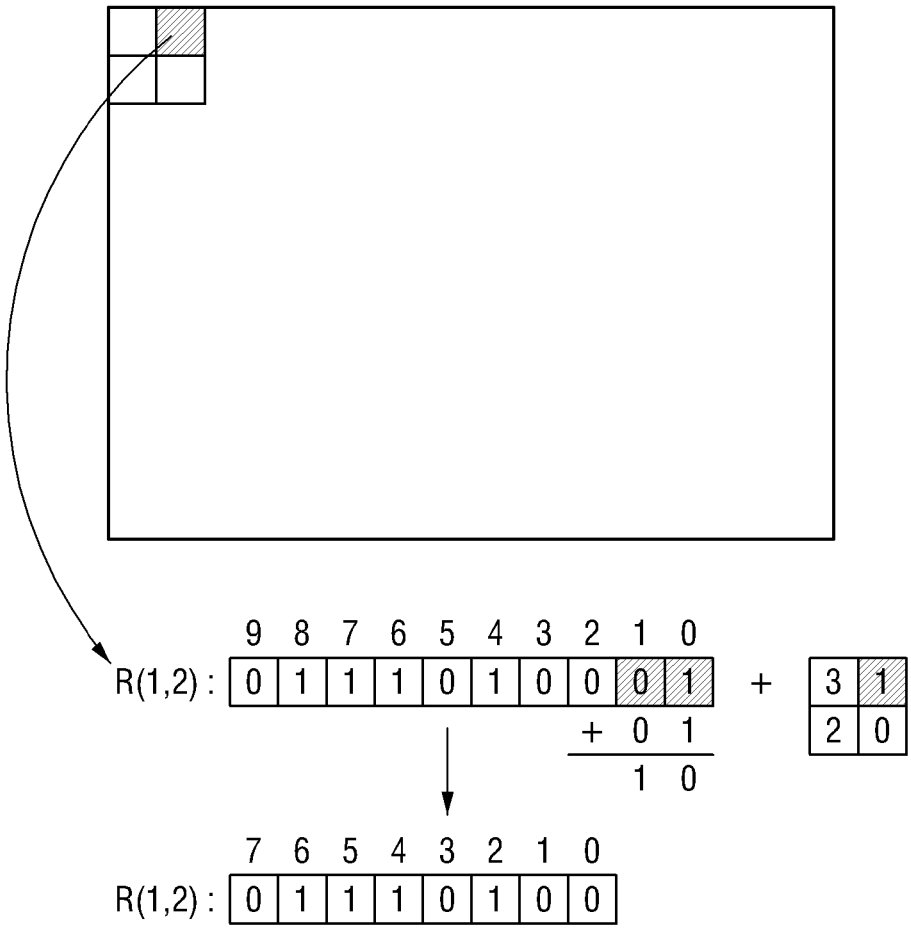

FIG. 5B illustrates a front dithering operation performed with respect to an R signal of a pixel [1, 2] of a video signal. In FIG. 5B, the R signal of the pixel [1, 2] is 0111010001. In order to perform a front dithering operation with respect to the R signal of the pixel [1, 2], a coefficient 1 at [1, 2] of the front mask is used. More specifically, the sum of lower 2 bits, 01, of the R signal and a binary number, 01, of the coefficient 1 at [1, 2] of the front mask is calculated. The calculation result ($01_2+01_2=10_2$) is 2 bits, which does not require rounding up the number of bits. Accordingly, only the lower 2 bits of the R signal is removed. Then, the R signal becomes 01110100 as a result of performing the front dithering operation with respect to the R signal of the pixel [1, 2] of the video signal.

The coefficient 2 at [2, 1] of the front mask is used for a front dithering operation for the pixel [2, 1], and the coefficient 0 at [2, 2] of the front mask is used for a front dithering operation for the pixel [2, 2].

Up to now, the front dithering operation for the R signal of the pixels [1, 1], [1, 2], [2, 1] and [2, 2] has been described. With respect to G and B signals of the pixels [1, 1], [1, 2], [2, 1] and [2, 2], the same or similar front dithering operation is performed. Also, regarding the other pixels, the same or similar front dithering operation is performed.

As described above, the front dithering unit 129-5 performs the front dithering operation in operation S420, thereby outputting an 8-bit-unit video signal. The front mask used in operation S420 is randomly determined by the LFSR.

The color processor 129-7 performs a color processing operation with respect to the video signal dithered in operation S420 (S430). The color processing operation performed in operation S430 may include color correction, white balance adjustment, and gamma correction, as mentioned above. The video signal is converted into a 14-bit-unit video signal by the color processing operation because the color processing operation increases a bit resolution of the video signal.

The post dithering unit 129-9 dithers lower 4 bits of the 14-bit-unit video signal which has been converted by the color processing operation (S430) according to the error diffusion dithering scheme (S440).

The post dithering unit 129-9 dithers the next lower 2 bits according to the spatial and temporal dithering scheme using the 2×2 post mask (S450). In operation S450, a post mask which is paired with the front mask used in the front dithering operation (S420) is used.

Figure 6:
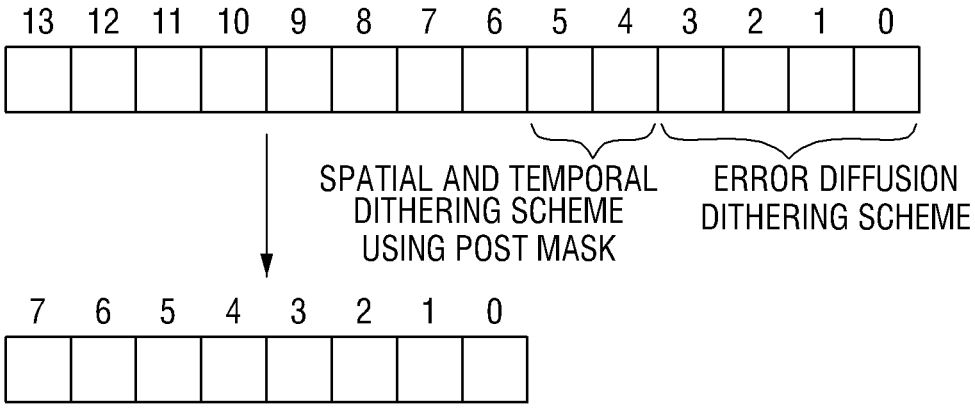
FIG. 6 is a view illustrating a post dithering operation performed in operations S440 and S450 of FIG. 4.

FIG. 6 is a view illustrating operations S440 and S450. Referring to FIG. 6, the lower 4 bits of the 14-bit-unit video signal which has been color processed are dithered according to the error diffusion dithering scheme, and the next lower 2 bits are dithered according to the spatial and temporal dithering scheme using the 2×2 post mask.

The error diffusion dithering converts the video signal which has been color processed into a 10-bit-unit video signal, and the spatial and temporal dithering converts the 10-bit-unit video signal into an 8-bit-unit video signal using the 2×2 post mask.

The spatial and temporal dithering using the 2×2 post mask is the same or similar as the spatial and temporal dithering using the 2×2 front mask, except for the mask used in the respective dithering, and thus a detailed description thereof is omitted. Hereinafter, the error diffusion dithering operation will be described in detail.

Figure 7:
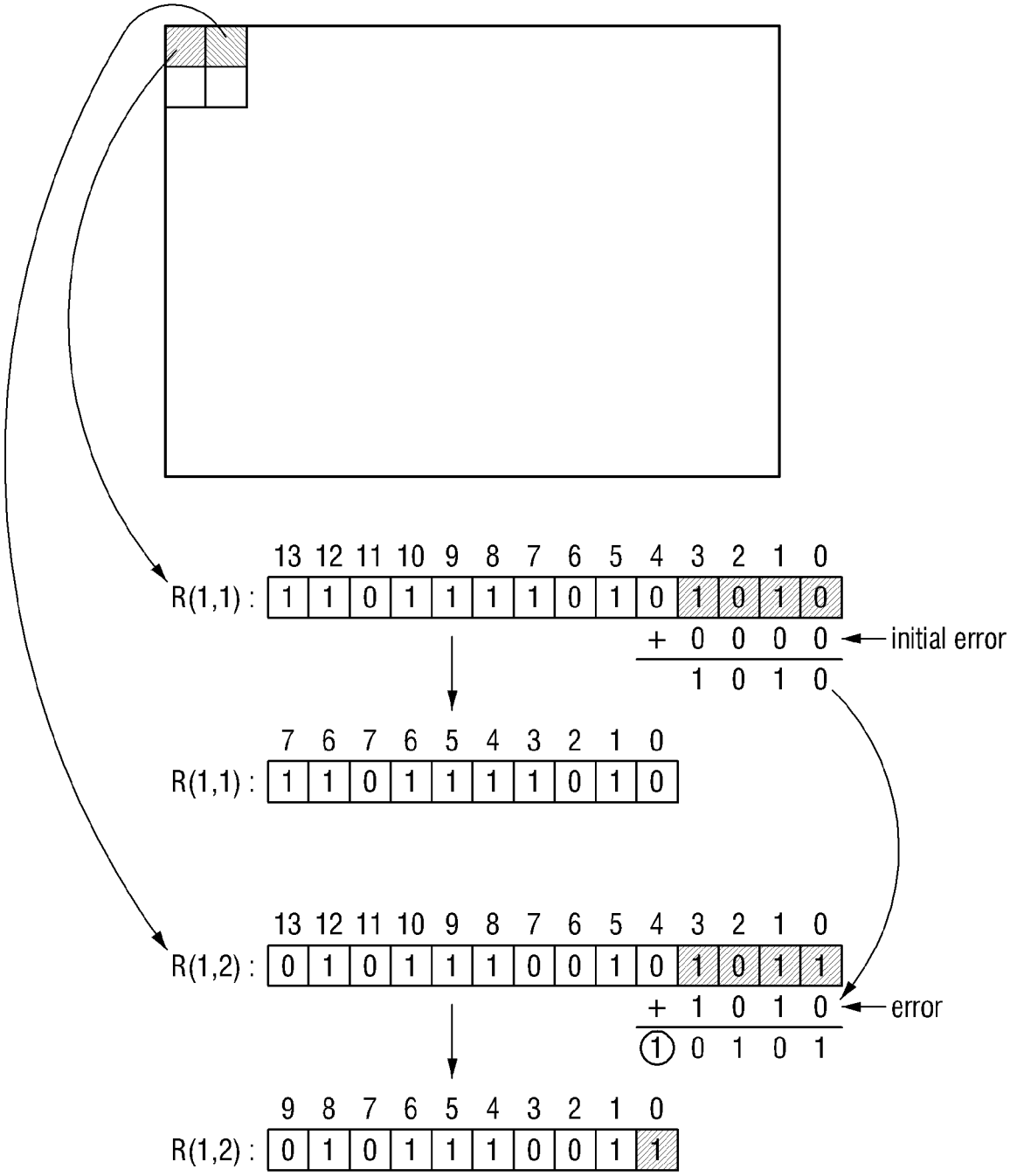
FIG. 7 is a view provided to explain an error diffusion dithering operation performed in operation S440 of FIG. 4.

In order to provide a detailed description of the error diffusion dithering operation performed in operation S440, FIG. 7 illustrates an error diffusion dithering operation performed with respect to an R signal of a pixel and an R signal of a pixel [1, 2] of a video signal which has been color processed.

In FIG. 7, the R signal of the pixel [1, 1] is 11011110101010 and an initial error is 0000. In order to perform the dithering operation with respect to the R signal of the pixel [1, 1], the sum of lower 4 bits 1010 of the R signal and the initial error 0000 is calculated. The calculation result ($1010_2+0000_2=1010_2$) is 4 bits, which does not require rounding up the number of bits. Accordingly, only the lower 4 bits of the R signal are removed. Then, the R signal becomes "1101111010" as a result of performing the error diffusion dithering operation with respect to the R signal of the pixel [1, 1] of the video signal.

In FIG. 7, the R signal of the pixel [1, 2] is 01011100101011 and an error 1010 is the sum of the lower 4 bits 1010 of the R signal of the pixel [1, 1] and the initial error 0000. In order to perform the dithering operation with respect to the R signal of the pixel [1, 2], the sum of lower 4 bits 1011 of the R signal and the error 1010 is calculated. The calculation result ($1011_2+1010_2=10101_2$) is 5 bits, which requires rounding up the number of bits. Accordingly, the lower 4 bits of the R signal are removed and 1 is added to the final bit. Then, the R signal becomes 0101110011 as a result of performing the error diffusion dithering operation with respect to the R signal of the pixel [1, 2] of the video signal.

Up to now, the error diffusion dithering operation for the R signal of the pixels [1, 1] and [1, 2] has been described. With respect to G signal and B signals of the pixels [1, 1] and [1, 2], the same or similar error diffusion dithering operation may be performed. With respect to the other pixels, the same or similar error diffusion dithering operation may be performed.

Referring back to FIG. 4, a dithering operation to be performed if an 8-bit-unit video signal is input to the front dithering unit 129-5 will now be described in detail. If it is determined that an 8-bit-unit video signal is input to the front dithering unit 129-5 (S460-Y), the front dithering unit 129-5 does not perform a dithering operation with respect to the video signal. In particular, the front dithering unit 129-5 does not perform the dithering operation because the bit unit of the input video signal is 8 bits, which conforms to the requirement of the color processor 129-7 such that no dithering operation is required.

Accordingly, the color processor 129-7 performs a color processing operation with respect to the video signal which has not been dithered by the front dithering unit 129-5 (S470). In operation S470, the video signal is converted into a 14-bit-unit video signal by the color processing operation.

The post dithering unit 129-9 dithers lower 2 bits of the 14-bit-unit video signal which has been converted by the color processing operation (S470) according to the error diffusion dithering scheme (S480).

The post dithering unit 129-9 dithers the next lower 4 bits according to the spatial and temporal dithering scheme using a 4×4 mask (S490).

Figure 8:
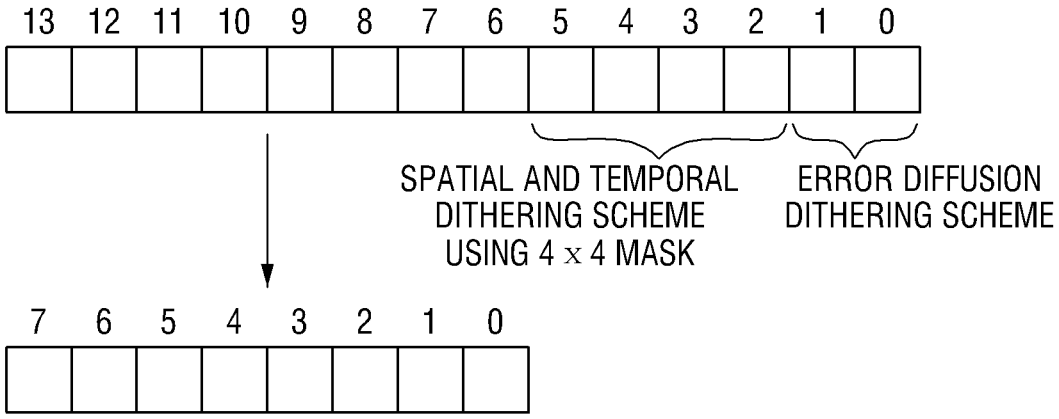
FIG. 8 is a view illustrating a post dithering operation performed in operations S480 and S490 of FIG. 4.

FIG. 8 illustrates operations S480 and S490. Referring to FIG. 8, the lower 2 bits of the 14-bit-unit video signal which has been color processed are dithered according to the error diffusion dithering scheme, whereas the next lower 4 bits are dithered according to the spatial and temporal dithering scheme using the 4×4 mask.

In operations S480 and S490, the lower 2 bits are dithered according to the error diffusion dithering scheme, and the next lower 4 bits are dithered according to the spatial and temporal dithering scheme. On the other hand, in operations S440 and S450, the lower 4 bits are dithered according to the error diffusion dithering scheme, and the next lower 2 bits are dithered according to the spatial and temporal dithering scheme.

This difference is caused by complementary use between the front mask and the post mask. That is, the reason why the 2×2 post mask is used in dithering the 2 bits according to the spatial and temporal dithering scheme in operation S450 is that the 2×2 front mask has been used in dithering the 2 bits according to the spatial and temporal dithering scheme in operation S420.

Since the error diffusion dithering operation performed with respect to the lower 2 bit in operation S480 is similar to the error diffusion dithering operation performed with respect to the lower 4 bits in operation S440, a detailed description thereof is omitted.

Also, since the spatial and temporal dithering operation performed with respect to the lower 4 bits in operation S490 is similar to the spatial and temporal dithering operation performed with respect to the lower 2 bits in operation S450, a detailed description thereof is omitted.

5. Variations (1) Bit Unit

In the above exemplary embodiment, the video signal input to the front dithering unit 129-5 is of an 8-bit unit or a 10-bit unit. However, this is merely an example for convenience of explanation. That is, in another exemplary embodiment, a video signal input to the front dithering unit 129-5 is not of an 8-bit unit or a 10-bit unit.

Also, in the above exemplary embodiment, the video signal output from the color processor 129-7 is of a 14-bit unit. However, this is merely an example for convenience of explanation. That is, in another exemplary embodiment, a video signal output from the color processor 129-7 is not of a 14-bit unit.

(2) Front Mask and Pose Mask

In the above exemplary embodiment, the front mask and the post mask has a format of 2×2. However, it is understood that the front mask and the post mask are not limited to the format of 2×2 in all exemplary embodiments, and the format may be changed in another exemplary embodiment. For example, if a 12-bit-unit video signal is to be dithered into an 8-bit-unit video signal through a front dithering operation, the front mask and the post mask may be realized in a 4×4 format.

Also, the coefficients of the front mask and the post mask mentioned in FIG. 3 are merely examples. That is, the coefficients of the front mask and the post mask are changeable while the complementary relationships are maintained in another exemplary embodiment. Also, the coefficients may be changed to be related to each other according to a specific regulation even if their complementary relationships are not maintained, according to another exemplary embodiment.

(3) Front Dithering

Referring to FIG. 4, a 2×2 front mask is used in the front dithering operation (S420) in order to dither a 10-bit-unit video signal into an 8-bit-unit video signal. However, in another exemplary embodiment, if a 12-bit-unit video signal is to be dithered into an 8-bit-unit video signal, a 4×4 front mask may be substituted for the 2×2 front mask. Similarly, in this case, a post mask used in the post dithering operation (S450) may have a format of 4×4.

(4) Post Dithering

In FIG. 4, the 14-bit-unit video signal is converted into an 8-bit-unit video signal through the post dithering operation (S440 and S450). More specifically, the video signal loses 4 bits in operation S440 and loses 2 bits in operation S450.

However, in another exemplary embodiment, if the video signal is set to lose 4 bits by the spatial and temporal dithering operation in operation S450, that is, if a 4×4 post mask is used, the error diffusion dithering operation in operation S440 may be performed with respect to the lower 2 bits.

Furthermore, the 4×4 mask used in the spatial and temporal dithering operation in operation S490 may be substituted with a 6×6 mask in another exemplary embodiment. However, in this case, operation S480 may be skipped because an 8-bit-unit video signal is generated by operation S490.

Figure 9:
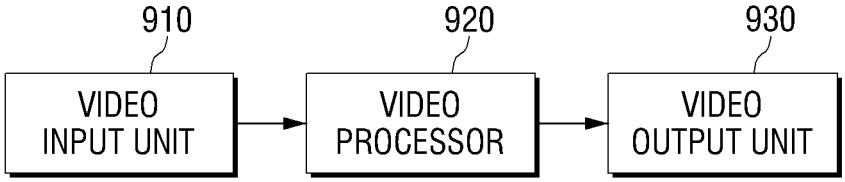
FIG. 9 is a block diagram illustrating a monitor, which is another example of a video display apparatus according to an exemplary embodiment.

(5) Monitor, Another Example of a Display Apparatus According to an Exemplary Embodiment FIG. 9 is a block diagram illustrating a monitor, which is another example of a video display apparatus according to an exemplary embodiment. As shown in FIG. 9, the monitor includes a video input unit 910, a video processor 920, and a video output unit 930.

The video input unit 910 receives a video signal, which is generated by a personal computer. The video processor 920 performs signal-processing with respect to the video signal input through the video input unit 910. The video processor 920 of FIG. 9 may be the same as the video processor 129 of FIG. 3. The video output unit 930 displays the video signal that is output from the video processor 920.

While the above exemplary embodiments are described with reference to a DTV and a monitor, it is understood that other exemplary embodiments may be applied to any device that can display a video on a display or process a video signal (such as a set-top box, a computer, etc.).

As described above, the dithering operation is performed using the related masks, thus preventing poor gradation of the video signal.

While not restricted thereto, the exemplary embodiments can also be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, the exemplary embodiments may be written as computer programs transmitted over a computer-readable transmission medium, such as a carrier wave, and received and implemented in general-use digital computers that execute the programs. Moreover, while not required in all aspects, one or more units of the DTV, the monitor, and/or the video processor 129 or 920 can include a processor or microprocessor executing a computer program stored in a computer-readable medium, such as the storage unit 170.

The foregoing exemplary embodiments and advantages are merely exemplary and are not to be construed as limiting the present inventive concept. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A video display apparatus comprising:

a video processor which signal-processes an input video signal; and a video output unit which displays the signal-processed video signal on a display, wherein the video processor comprises:

a first dithering unit which dithers the input video signal using a first mask;

a color processor which color-processes the dithered video signal output from the first dithering unit; and a second dithering unit which dithers the color-processed video signal using a second mask related to the first mask, wherein the second dithering unit uses, as the second mask, a mask determined from among a plurality of predetermined masks according to the first mask used by the first dithering unit, wherein, in response to a first predetermined mask being selected, by the first dithering unit, as the first mask, a corresponding second predetermined mask is subsequently selected, by the second dithering unit, as the second mask according to the selection of the first predetermined mask, and wherein a sum of coefficients at a location corresponding to the first mask is equal to a sum of coefficients at a location corresponding to the second mask.

2. The video display apparatus as claimed in claim 1, wherein the first mask has a same format as the second mask.

3. The video display apparatus as claimed in claim 2, wherein the second mask comprises coefficients that compensate for corresponding coefficients of the first mask.

4. The video display apparatus as claimed in claim 1, wherein the second dithering unit dithers the color-processed video signal using an error diffusion dithering scheme, and dithers the error diffusion-dithered video signal using the second mask.

5. The video display apparatus as claimed in claim 1, wherein the first dithering unit dithers the input video signal using the first mask if a bit unit of the input video signal exceeds a predetermined bit unit, and does not dither the input video signal if the bit unit of the input video signal is the predetermined bit unit.

6. The video display apparatus as claimed in claim 5, wherein the second dithering unit dithers the color-processed video signal using the second mask if a bit unit of the input video signal input to the first dithering unit exceeds the predetermined bit unit, and dithers the color-processed video signal using a third mask if the bit unit of the input video signal input to the first dithering unit is the predetermined bit unit.

7. The video display apparatus as claimed in claim 6, wherein the third mask has a format which is larger than a format of the second mask.

8. The video display apparatus as claimed in claim 1, wherein the input video signal is a video signal which is separated from a received broadcast signal or a video signal which is received from an external apparatus.

9. A video display method, comprising:

dithering a video signal using a first mask;

color-processing the dithered video signal;

dithering the color-processed video signal using a second mask related to the first mask; and outputting the dithered video signal, wherein the second mask is determined from among a plurality of predetermined masks according to the first mask, wherein, in response to a first predetermined mask being selected as the first mask, a corresponding second predetermined mask is subsequently selected as the second mask according to the selection of the first predetermined mask, and wherein a sum of coefficients at a location corresponding to the first mask is equal to a sum of coefficients at a location corresponding to the second mask.

10. The video display method as claimed in claim 9, wherein the outputting the dithered video signal comprises displaying the dithered video signal on a display.

11. The video display method as claimed in claim 9, wherein the first mask has a same format as the second mask.

12. The video display method as claimed in claim 11, wherein the second mask comprises coefficients that compensate for corresponding coefficients of the first mask.

13. The video display method as claimed in claim 9, wherein the dithering the color-processed video signal using the second mask comprises dithering the color-processed video signal using an error diffusion dithering scheme, and dithering the diffusion-dithered video signal using the second mask.

14. The video display method as claimed in claim 9, wherein the dithering the video signal using the first mask comprises dithering the first video signal using the first mask if a bit unit of the video signal exceeds a predetermined bit unit, and not dithering the video signal if the bit unit of the video signal is the predetermined bit unit.

15. The video display method as claimed in claim 14, wherein the dithering the color-processed video signal using the second mask comprises dithering the color-processed video signal using the second mask if a bit unit of the video signal exceeds the predetermined bit unit, and dithering the color-processed video signal using a third mask if the bit unit of the video signal is the predetermined bit unit.

16. The video display method as claimed in claim 15, wherein the third mask has a format which is larger than a format of the second mask.

17. The video display method as claimed in claim 9, wherein the video signal is a video signal which is separated from a received broadcast signal or a video signal which is received from an external apparatus.

18. A non-transitory computer readable recording medium having recorded thereon a program executable by a computer for performing the method of claim 9.

19. A video processor comprising:

a first dithering unit which dithers a video signal using a first mask;

a color processor which color-processes the dithered video signal output from the first dithering unit; and a second dithering unit which dithers the color-processed video signal using a second mask related to the first mask, wherein the second dithering unit uses, as the second mask, a mask determined from among a plurality of predetermined masks according to the first mask used by the first dithering unit, wherein, in response to a first predetermined mask being selected, by the first dithering unit, as the first mask, a corresponding second predetermined mask is subsequently selected, by the second dithering unit, as the second mask according to the selection of the first predetermined mask, and wherein a sum of coefficients at a location corresponding to the first mask is equal to a sum of coefficients at a location corresponding to the second mask.

20. The video display apparatus as claimed in claim 1, wherein the plurality of predetermined masks have predetermined coefficients.

21. The video display apparatus as claimed in claim 1, wherein the first dithering unit dithers lower two bits of the video signal and the second dithering unit dithers lower two bits of the color-processed video signal.

* * * * *